US008181588B2

(12) United States Patent
Fan et al.

(10) Patent No.: US 8,181,588 B2
(45) Date of Patent: May 22, 2012

(54) AUTOMATIC REVERSING-REPOSITION ROCKER ARM

(75) Inventors: Zhi Xia Fan, Tianjin (CN); Ru Hua Yuan, Tianjin (CN); Hui Xu, Tianjin (CN); Tao Geng, Tianjin (CN); Huai Liang Li, Tianjin (CN); Yong Li Li, Tianjin (CN); Qing Ren Shen, Tianjin (CN)

(73) Assignees: China National Offshore Oil Corp., Beijing (CN); China Offshore Oil Engineering Co., Ltd, Tianjin (CN)

( * ) Notice: Subject to any disclaimer, the term of this patent is extended or adjusted under 35 U.S.C. 154(b) by 282 days.

(21) Appl. No.: 12/605,356

(22) Filed: Oct. 25, 2009

(65) Prior Publication Data

US 2011/0094434 A1 Apr. 28, 2011

(51) Int. Cl.
*B63B 35/44* (2006.01)
*B63B 39/03* (2006.01)

(52) U.S. Cl. ..... 114/258; 114/125

(58) Field of Classification Search ..... 114/258, 114/317, 121, 122, 124–126, 260
See application file for complete search history.

(56) References Cited

U.S. PATENT DOCUMENTS 3,054,267 A * 9/1962 Alcorn et al. ..... 405/209
4,632,370 A * 12/1986 Ticks et al. ..... 267/219
4,683,832 A * 8/1987 Dysarz ..... 114/258
4,927,296 A * 5/1990 Kaldenbach ..... 405/206

* cited by examiner

*Primary Examiner* — Lars A Olson
*Assistant Examiner* — Andrew Polay

(57) ABSTRACT

An automatic reversing-reposition rocker arm includes a rocker arm body, and the rocker arm body is a steel box beam. A rocker arm pivoting shaft is attached on a middle of the body. The rocker arm body has a ballast tank, a water inlet, and a water outlet. The ballast tank is located in a back end of the rocker arm body. The water inlet is located in an upper edge of the ballast tank. The water outlet is located in a lower edge of the ballast tank. A left side and a right side of a lengthwise forth end of the rocker arm pivoting shaft match each other, and a plurality of connecting devices are attached on the forth end of the rocker arm body. A plurality of gas-liquid buffers connects with the rocker arm body via the connecting devices.

5 Claims, 4 Drawing Sheets

AUTOMATIC REVERSING-REPOSITION ROCKER ARM

BACKGROUND OF THE INVENTION

1. Field of the Invention

The present invention relates to an auxiliary device for barge construction, in particular, an automatic reversing-reposition rocker arm for sliding a large jacket from launch barge into the water. The auxiliary device is usually used in the marine oil engineering field.

2. Description of Related Art

The launch barge is different from other barges, two rocker arms with pivoting shaft are provided on the barge stern, and the rocker arm is a steel arm for supporting the jacket to rock together just after the jacket sliding into the water.

As shown in FIG. 1, the existing rocker arm includes a rocker arm body 1, and the rocker arm body 1 is formed by welding an outer plate and some crossed inner partitions to make a steel box beam. On the center of the bottom of the rocker arm, a rocker arm pivoting shaft 3 is attached by welding, and the revolving point of the pivoting shaft 3 is on the after-perpendicular line.

When using, a pair of rocker arms are attached in the groove of the barge stern, and the distance of both rocker arms are in accordance with the engineering requirement of the skid beams spacing, the rocker arm pivoting shafts are fastened to the groove of the barge stern by a locking device, so as to make the rocker arm pivoting about the shaft. Half of the rocker arm extends beyond the stern. The head of the rocker arm connects with two longitudinal skid beams of the main deck which cross through the barge. The rocker arm and the skid beams can be adjusted near the middle of the barge to meet the different sizes of jacket launching. At the last stage of the jacket launching, the whole weight of the jacket applies to the rocker arm, and the jacket is launched by the reversal of the rocker arm.

After rocker arm is reversed following the launching of the jacket, usually, the external force acting on the rocker arm and the self weight of the rocker arm is not enough to make the rocker arm to automatically reverse and reposition, and its reversal and reposition is made by means of external force and manual operation. It not only wastes the construction cost, but also increases the risk of offshore engineering. Owing to the larger moment of inertia of the rocker arm about the pivot shaft, the reposition by means of the external force is hard to control the angular velocity of the rocker arm, thus, it is easy that the deck is damaged to some extent by the impact force of reposition.

SUMMARY OF THE INVENTION

The objective of the present invention is to overcome the above disadvantages of the existing rocker arm, and to provide an automatic reversing-reposition rocker arm, in which ensuring a safe the jacket launching, while the rocker arm can automatically reverse to reposition after the jacket has launched, and the impact force of the rocker arm applying on the deck is decreased. At the same time, the safety of the offshore engineering is also improved.

The objective of the present invention is achieved by the following technical scheme.

An automatic reversing-reposition rocker arm includes a rocker arm body, which is a steel box beam, and along the lengthwise of the bottom, a rocker arm pivoting shaft is engaged to the middle the body. The characteristic lies in that the rocker arm body has a ballast tank, which has a water inlet and a water outlet; The ballast tank is located in the back end of the rocker arm body, and the water inlet is located in an upper edge of the ballast tank; the water outlet is located in a lower edge of the ballast tank. The left side and the right side of the lengthwise front end of the rocker arm pivoting shaft correspond to each other, and a plurality of connecting devices 7 are spacedly connected to the rocker arm body; the rocker arm body has a plurality of gas-liquid buffers connected with the rocker arm body via the connecting devices and therefore integrated to one unit.

The capacity of said ballast tank is 14-16 tons. Said capacity of the ballast tank corresponds to a launching volume, shape, self-weight and a center-of-gravity position of the rocker arm.

Each connecting device of the gas-liquid buffer has a U-shape frame, in which two side toggle plates are welded on to the rocker arm body. A middle of a bottom panel of the U-shape frame has a through hole, a plurality of screw holes are disposed around the through hole, and correspond to a plurality of holes defined in each gas-liquid buffer. The gas-liquid buffers are installed in the through holes, and a plurality of binding bolts pass through the holes of the gas-liquid buffers and the corresponding screw holes, thus fixed the gas-liquid buffers to the bottom panel of the U-shape frame.

On each of the back and forth ends of said rocker arm body, one lifting eye is welded. The lifting eye is a steel tube, and the lifting eye welded at the back end of the rocker arm body is also used as a water inlet communicating with the ballast tank; the lifting eye welded at the forth end of the rocker arm body is a steel tube or steel shaft.

Said rocker arm body is bilaterally symmetrical about Y-axis.

The advantageous effects of the present invention are described as follows.

The present invention adopts the above technical scheme, in particular, the present invention has a rocker arm body which has a ballast tank having a water inlet, a water outlet and the ballast tank has a capacity of 14-16 tons; the present invention also provides a plurality of gas-liquid buffers, thus, the jacket launching is safe, while the rocker arm can automatically reverse to reposition after the jacket launched, and the impact force of the rocker arm applying on the deck is decreased, avoiding the damage to the deck, therefore increase the safety of offshore construction. The present invention has a simple structure, thus the cost of construction is saved. Furthermore, the present invention is easy to operate, and is convenient to maintain.

DETAILED DESCRIPTION OF THE INVENTION

Figure 1:
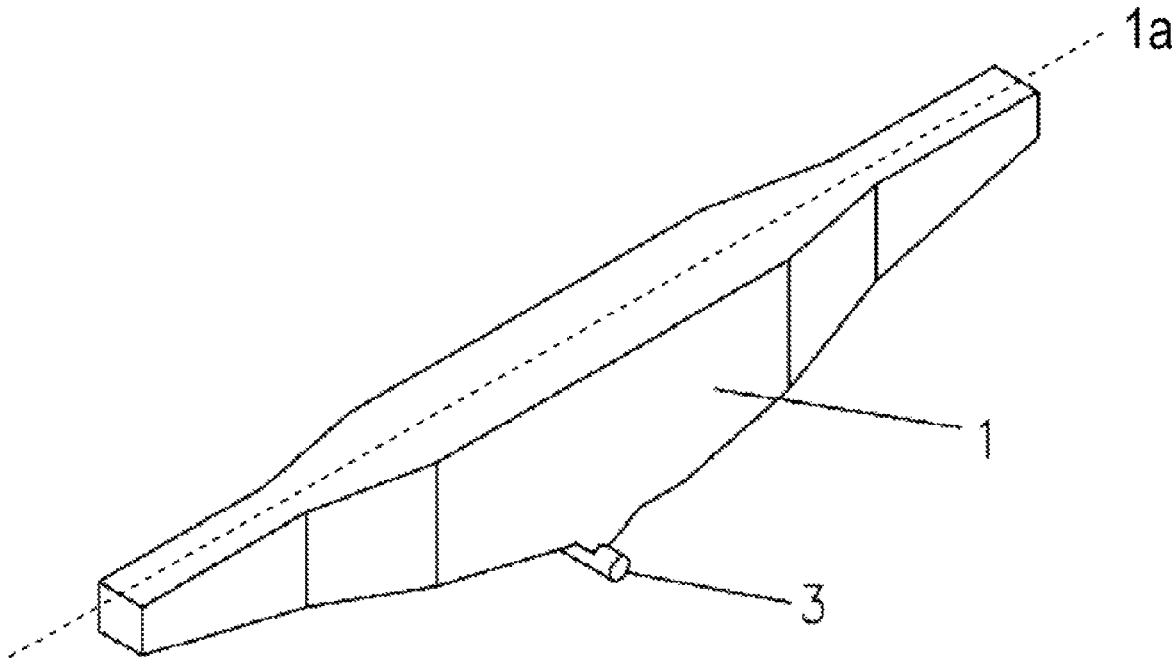
FIG. 1 shows a diagrammatic drawing of three-dimensional structure of the prior art.
Figure 2:
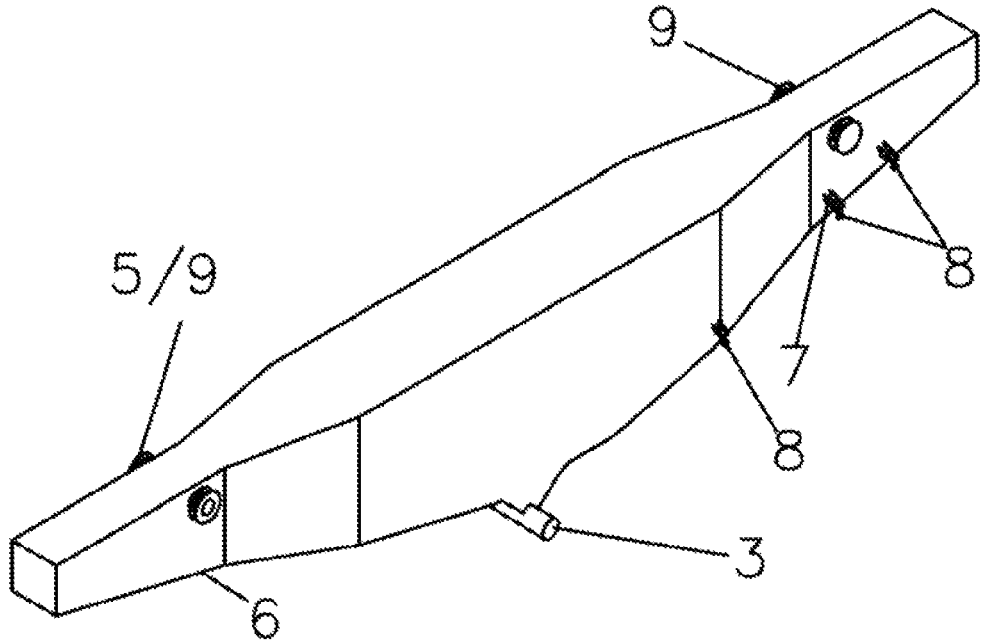
FIG. 2 shows a diagrammatic drawing of three-dimensional structure of the present invention.
Figure 3:
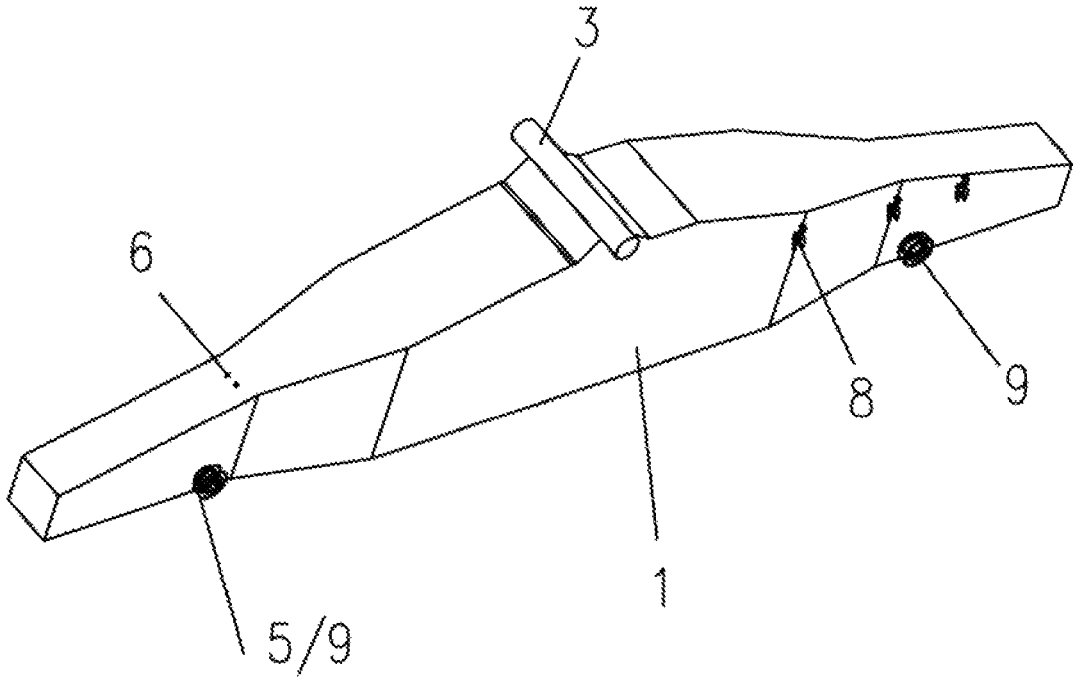
FIG. 3 shows another diagrammatic drawing of three-dimensional structure of the present invention.
Figure 4:
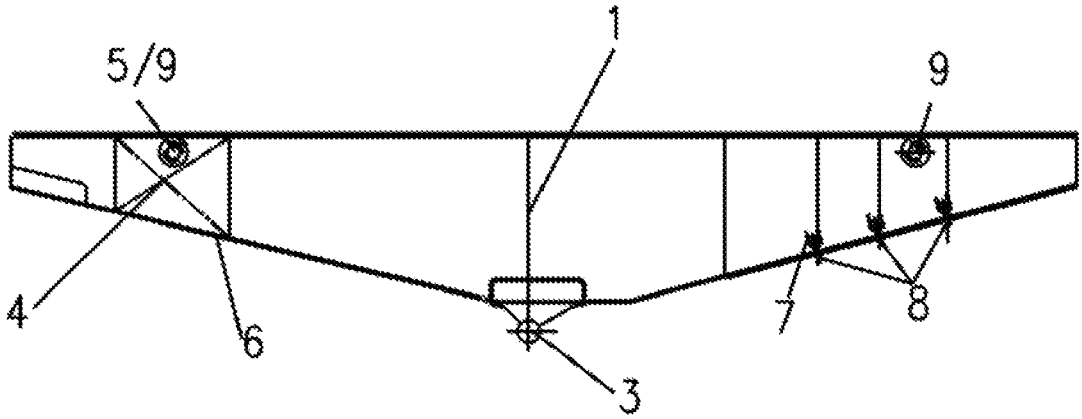
FIG. 4 shows a diagrammatic drawing of the water inlet and the water outlet arrangement of the ballast tank of the present invention.

As shown in FIGS. 2-4, the present invention comprises a rocker arm body 1, and the rocker arm body 1 is formed by an outer plate and a plurality of crossed inner partitions to make the rocker arm body a steel box beam. The steel plates are welded to form the rocker arm body and the rocker arm body is bilaterally symmetrical about a Y-axis 1*a*. Along the lengthwise of the bottom, a rocker arm pivoting shaft 3 is engaged to a middle of the rocker arm body 1. The rocker arm body 1 can be fastened to a tail of a barge by a locking device 2, thus it can prevent the rocker arm body 1 from pulling out. In the course of jacket's launching, the rocker arm body 1 can pivot about the rocker arm pivoting shaft 3.

The rocker arm body 1 has a ballast tank 4, which has a water inlet 5 and a water outlet 6. The ballast tank 4 is located on a back end of the rocker arm body 1, and the water inlet 5 is located on an upper edge of the ballast tank 4; the water outlet 6 is located on a lower edge of the ballast tank 4. A capacity of the ballast tank 4 is 14-16 tons. The capacity of the ballast tank corresponds to the launching volume, shape, self weight and center-of-gravity position of the rocker arm, so as to make the rocker arm to automatically reverse and reposition after jacket's launching, and keep the impact force of the reversal reposition in an allowable range. A left end and a right end of the rocker arm pivoting shaft 3 correspond to each other. A plurality of gas-liquid buffers 8 are correspondingly attached to a plurality of connecting devices 7. The gas-liquid buffers 8 are connected with the rocker arm body 1 via the connecting devices 7 and integrated to one unit. Each connecting device 7 is used for fixing one of the gas-liquid buffers 8.

Figure 5:
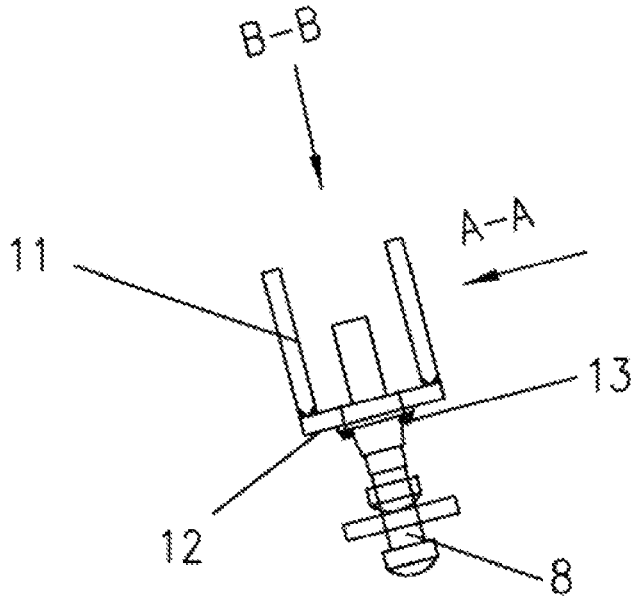
FIG. 5 shows a diagrammatic drawing of the gas-liquid buffers connecting device of FIG. 3 and FIG. 4.
Figure 6:
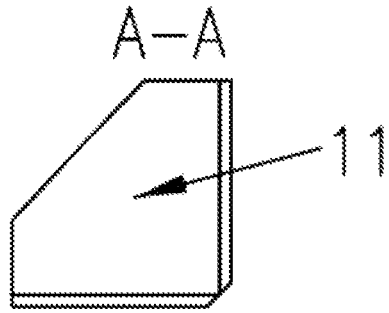
FIG. 6 shows a diagrammatic drawing along A-A of FIG. 5.
Figure 7:
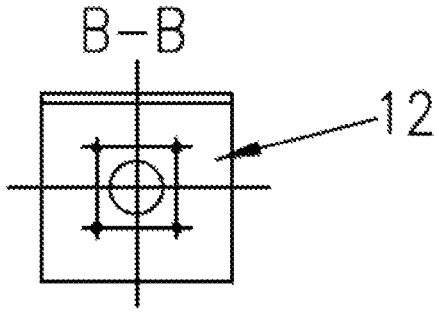
FIG. 7 shows a diagrammatic drawing along B-B of FIG. 5.

The present embodiment is shown as follows: the rocker arm body 1 has six connecting devices 7 disposed on the three positions of lengthwise of the forth end of the rocker arm body, every two connecting devices 7 are bisymmetrical disposed on the forth end of the rocker arm body 1. As shown in FIG. 5-FIG. 7, each of the connecting devices 7 include a U-shape frame in which two side toggle plates 11 are welded on to the rocker arm body 1. A middle of a bottom panel 12 of the U-shape frame 10 has a through hole, and a plurality of screw holes corresponding to a plurality of holes on the gas-liquid buffers 8. The gas-liquid buffers 8 are installed in the through holes, and a plurality of binding bolts 13 correspondingly pass through the holes of the gas-liquid buffers 8 and the corresponding screw holes, thus fixes the gas-liquid buffers 8 to the bottom panels 12 of the U-shape frames.

On each of the back and forth ends of the rocker arm body 1, one lifting eye 9 is welded and is used for lifting the rocker arm body 1. The present embodiment is shown as follows: The lifting eye 9 is a steel tube, and the lifting eye 9 installed at the back end of the rocker arm body 1 is also used as a water inlet 5 communicating with the ballast tank; the lifting eye 9 installed at the forth end of the rocker arm body 1 is a steel tube or steel shaft.

When using, the rocker arm body 1 is mounted on a groove of a stern of a barge, and is fixed to the stern by a locking device 2. Half of the rocker arm extends beyond the stern. The front end of the rocker arm body 1 connects with two longitudinal skid beams on a main deck, which extends through the barge. The rocker arm and the skid beams can be adjusted near a middle of the barge to adapt to launching of different jackets.

In the course of jacket launching, the rocker arm body 1 can pivot about the rocker arm pivoting shaft 3. At the initial stage of the jacket launching, the water inlet 5 of the ballast tank 4 submerges, and water enters the ballast tank 4. After the jacket and the rocker arm body 1 separate from each other, the barge tail lifts, and the water in the ballast tank 4 discharges from the water outlet 6 gradually.

Figure 8:
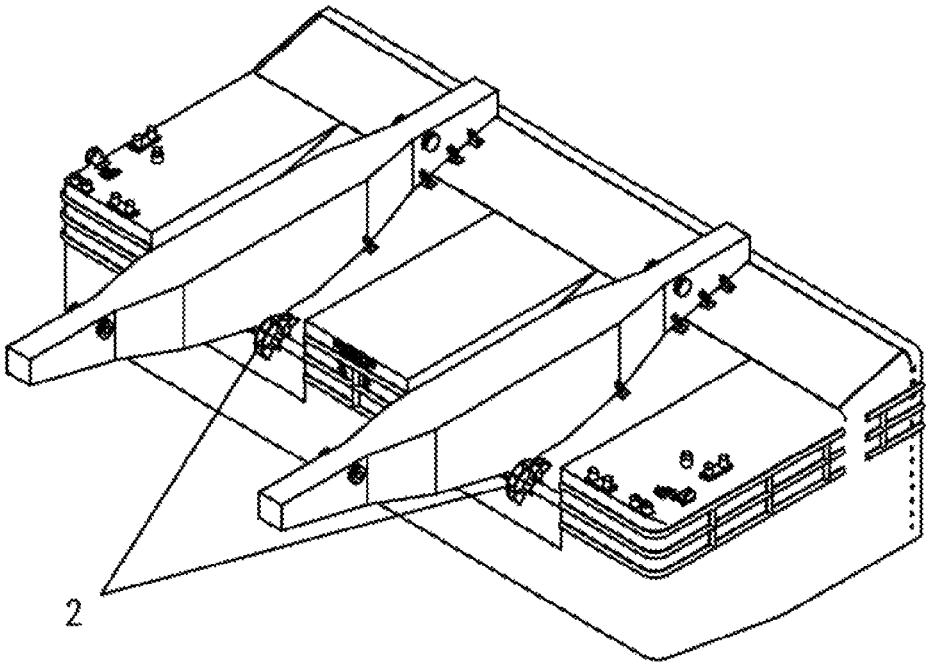
FIG. 8 shows a diagrammatic drawing of operating conditions when the present invention lies on the deck.
Figure 9:
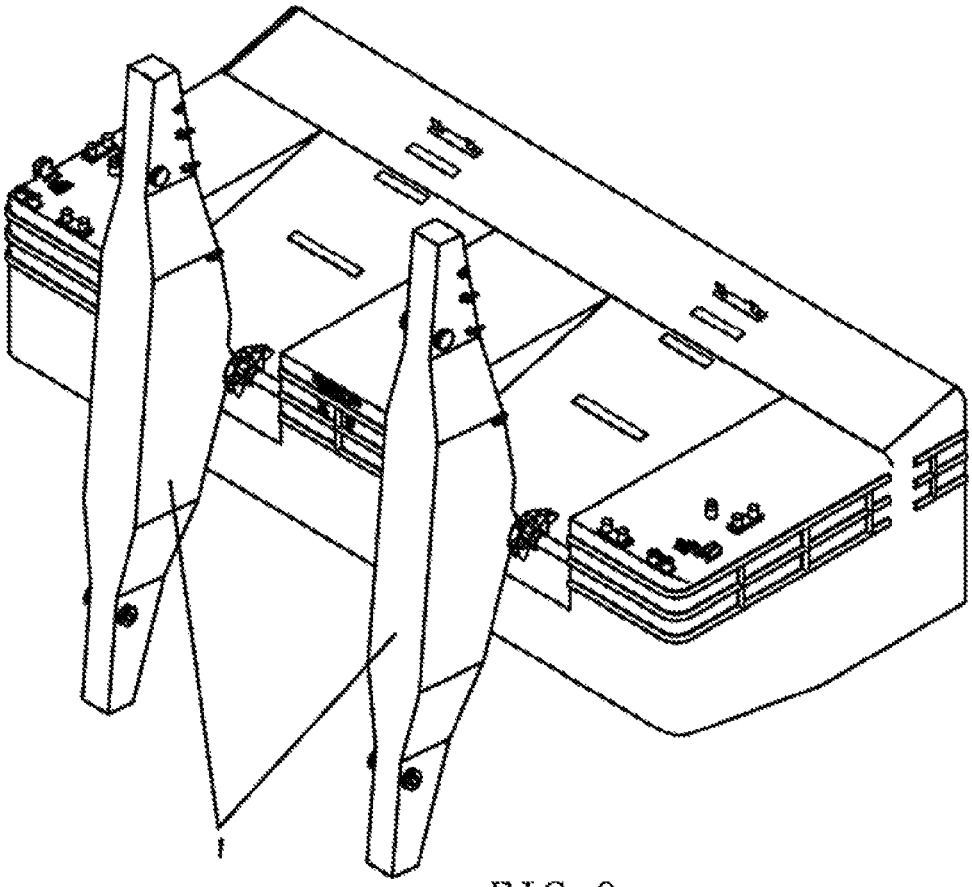
FIG. 9 shows a diagrammatic drawing of operating conditions when the present invention reverses.

The operation of the present invention is described as follows:

As shown in FIG. 8, FIG. 9, at the initial state of the jacket launching, the barge has a trim, thus it can resist a frictional force between the jacket and the skid beams. After adjustment state of the jacket launching, a part of the weight of the barge jacket applies to the rocker arm body 1 via skid beams, thus the rocker arm body 1 lies on the main deck, and the six gas-liquid buffers 8 contact with the main deck so that an initial pressure is maintained between them.

At this point, owing to the trim of the barge, most of the back end of the rocker arm body 1 is submersed, and seawater enters the ballast tank 4 through water inlet 5, therefore, a buoyancy force of the rocker arm is decreased, which prevents the rocker arm and the jacket from reversing towards the stern together. When the center-of-gravity position of the jacket moves longitudinally to the rocker arm pivoting shaft 3, the jacket will begin to follow the rocker arm body 1 to reverse towards the barge stern, and the gas-liquid buffers 8 on the forth end of the rocker arm body 1 will not contact with the main deck, thus the initial pressure instantly disappears.

With the jacket continually gliding down, a underwater depth of the stern becomes deeper, and the rocker arm pivots towards the stern; the center of gravity of the rocker arm passes the rocker arm pivoting shaft 3 of the rocker arm; a self weight of the rocker arm allows itself to form a moment, which enables the rocker arm to keep reversing towards the stern. Whereas after the jacket disengages from the rocker arm completely, the underwater depth of the stern becomes less deeper, and with the emergence of the water outlet 6 from the water, the seawater in the ballast tank 4 of the rocker arm flows out of the ballast tank 4, and the moment formed by the seawater in the ballast tank 4 and prevents the rocker arm from reversing to reposition, is deceased gradually.

The rocker arm body 1 begins to reverse to reposition due to the buoyancy force, and with the reversal of the rocker arm, the center of gravity of the rocker arm will pass over the pivoting shaft 3. The direction of the moment due to the self-weight of the rocker arm will change from the direction in which the makes the rocker arm reverse towards the stern to the direction, in which makes the rocker arm reversing to reposition. When the rocker arm automatically reverses to reposition and hit the deck with a certain angular velocity, the gas-liquid buffers 8 contact with the deck firstly. The gas-liquid buffers 8 are compressed instantaneously and absorb part of the kinetic energy of the rocker arm. The reversal velocity of the rocker arm is decreased greatly, and accordingly an impact force of the rocker arm applied to the deck is decreased, therefore, the rocker arm can automatically reverse to reposition safely.

The gas-liquid buffers 8 are available in the market, or can be made by various means of the existing technology.

The above description only shows the preferred embodiments of the present invention, and does not intend to limit the present invention. Any simple modifications, equivalent variation and embellishment, which are made based on the principle of the present invention, all fall within the scope of the technical solution of the present invention.

What is claimed is:

1. An automatic reversing-reposition rocker arm comprising a rocker arm body, the rocking body arm being a steel box beam, a rocker arm pivoting shaft attached on a middle of the rocker arm body, the rocker arm body having a ballast tank, a water inlet, and a water outlet, the ballast tank located in a back end of the rocker arm body, the water inlet located in an upper edge of the ballast tank, the water outlet located in a lower edge of the ballast tank, a plurality of connecting devices spacedly attached on a left side and a right side of a lengthwise forward end of the rocker arm body, a plurality of gas-liquid buffers correspondingly connected with the rocker arm body via the connecting devices;

wherein on each of the back and forward ends of said rocker arm body, one lifting eye is welded, the lifting eye being a steel tube, and the lifting eye at the back end of the rocker arm body used as a water inlet communicating with the ballast tank, the lifting eye at the forward end of the rocker arm body being a steel tube or steel shaft.

2. The automatic reversing-reposition rocker arm as claimed in claim 1, wherein a capacity of said ballast tank is 14-16 tons.

3. The automatic reversing-reposition rocker arm as claimed in claim 1, wherein the capacity of the ballast tank is based on the launching volume, shape, self-weight and the center-of-gravity position of the rocker arm.

4. The automatic reversing-reposition rocker arm as claimed in claim 1, wherein each connecting device of the gas-liquid buffer includes an U-shape frame, in which two side toggle plates welded on the rocker arm body, a middle of a bottom panel of the U-shape frame having a through hole, a plurality of screw holes defined around the through hole and correspondingly aligned with a plurality of holes defined in the gas-liquid buffers, the gas-liquid buffers provided in the through holes of the middle, and a binding bolt passing through one of the holes of the gas-liquid buffers and the corresponding screw hole so as to fix the gas-liquid buffers to the bottom panel of the U-shape frame.

5. The automatic reversing-reposition rocker arm as claimed in claim 1, wherein said rocker arm body is bilateral symmetry about a Y-axis.

* * * * *